United States Patent [19]

Steuer et al.

[11] 4,156,994

[45] Jun. 5, 1979

[54] GARAGE ASSEMBLY FOR TWO-WHEELED VEHICLES

[75] Inventors: Charles F. Steuer; Patricia A. Steuer, both of Walnutport, Pa.

[73] Assignee: Lawrence Peska Associates, Inc., New York, N.Y. ; a part interest

[21] Appl. No.: 837,581

[22] Filed: Sep. 28, 1977

[51] Int. Cl.[2] ..... E04B 1/346

[52] U.S. Cl. ..... 52/65; 312/202; 312/290

[58] Field of Search ..... 52/65, 236.1, 236.2, 52/79.4; 214/16.1 A; 312/97.1, 202, 135, 290

[56] References Cited

U.S. PATENT DOCUMENTS

| | | | |
|---|---|---|---|
| 1,780,102 | 10/1930 | Watt | 52/236.1 |
| 2,964,144 | 12/1960 | Wheeler | 52/65 |
| 3,257,154 | 6/1966 | Lewis | 52/DIG. 10 |
| 3,941,146 | 3/1976 | Chatard | 52/65 |
| 4,016,686 | 4/1977 | Hartger | 52/65 |

FOREIGN PATENT DOCUMENTS

| | | | |
|---|---|---|---|
| 43994 | 9/1928 | France | 52/DIG. 14 |
| 618268 | 2/1961 | Italy | 52/65 |
| 238101 | 10/1945 | Switzerland | 52/DIG. 14 |

*Primary Examiner*—Price C. Faw, Jr.
*Assistant Examiner*—Henry Raduazo

[57] ABSTRACT

A garage assembly for two-wheeled vehicles, the assembly comprising a rotatable circular frame, a plurality of housings connected to the frame, each housing including a floor portion having a back edge and a front edge, the length of the back edge being less than the length of the front edge, a back wall upstanding from the back edge, side walls upstanding from side edges of the floor portion, a front wall hingedly connected to the front edge, and a top portion shaped complementarily to the floor portion and hingedly connected to an upper edge of one of the side walls, the front wall and the top portion being movable between positions in which the housing is open and positions in which the housing is closed.

7 Claims, 1 Drawing Figure

GARAGE ASSEMBLY FOR TWO-WHEELED VEHICLES

BACKGROUND OF THE INVENTION

1. Field of the Invention

This invention relates to garages for vehicles and is directed more particularly to a garage assembly for two-wheeled vehicles, the assembly being of the circular rotatable type.

2. Description of the Prior Art

The advantages of circular rotatable storage buildings are known in the art and have been discussed previously, as for example in U.S. Pat. No. 3,815,298, issued June 11, 1974 to R. E. Pope. Earlier, in U.S. Pat. No. 636,324, issued Nov. 7, 1899 to G. Ehrenberg, there was shown a circular shed for housing bicycles and having therein rotatable storage means.

SUMMARY OF THE INVENTION

An object of the present invention is to provide a circular rotatable housing for two-wheeled vehicles, such as bicycles, motorcycles, and the like, in which each vehicle may be individually housed and locked.

A further object of the invention is to provide such an assembly in which each housing occupies only enough space to accept a two-wheeled vehicle, entry to and out of the space being feasible by hinged mounting of wall portions of the housing.

With the above and other objects in view, as will hereinafter appear, a feature of the present invention is the provision of a garage assembly for two-wheeled vehicles, the assembly comprising a rotatable circular frame means, a plurality of housings connected to the frame, each housing including a floor portion having a back edge and a front edge, the length of the back edge being less than the length of the front edge, a back wall upstanding from the back edge, side walls upstanding from side edges of the floor portion, a front wall hingedly connected to the front edge, and a top portion shaped complementarily to the floor portion and hingedly connected to an upper edge of one of the side walls, the front wall and the top portion being movable between positions in which the housing is open and positions in which the housing is closed.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

DESCRIPTION OF THE DRAWINGS

Reference is made to the accompanying drawings in which is shown an illustrative embodiment of the invention from which its novel features and advantages will be apparent.

DESCRIPTION OF THE PREFERRED EMBODIMENT

Figure 1:
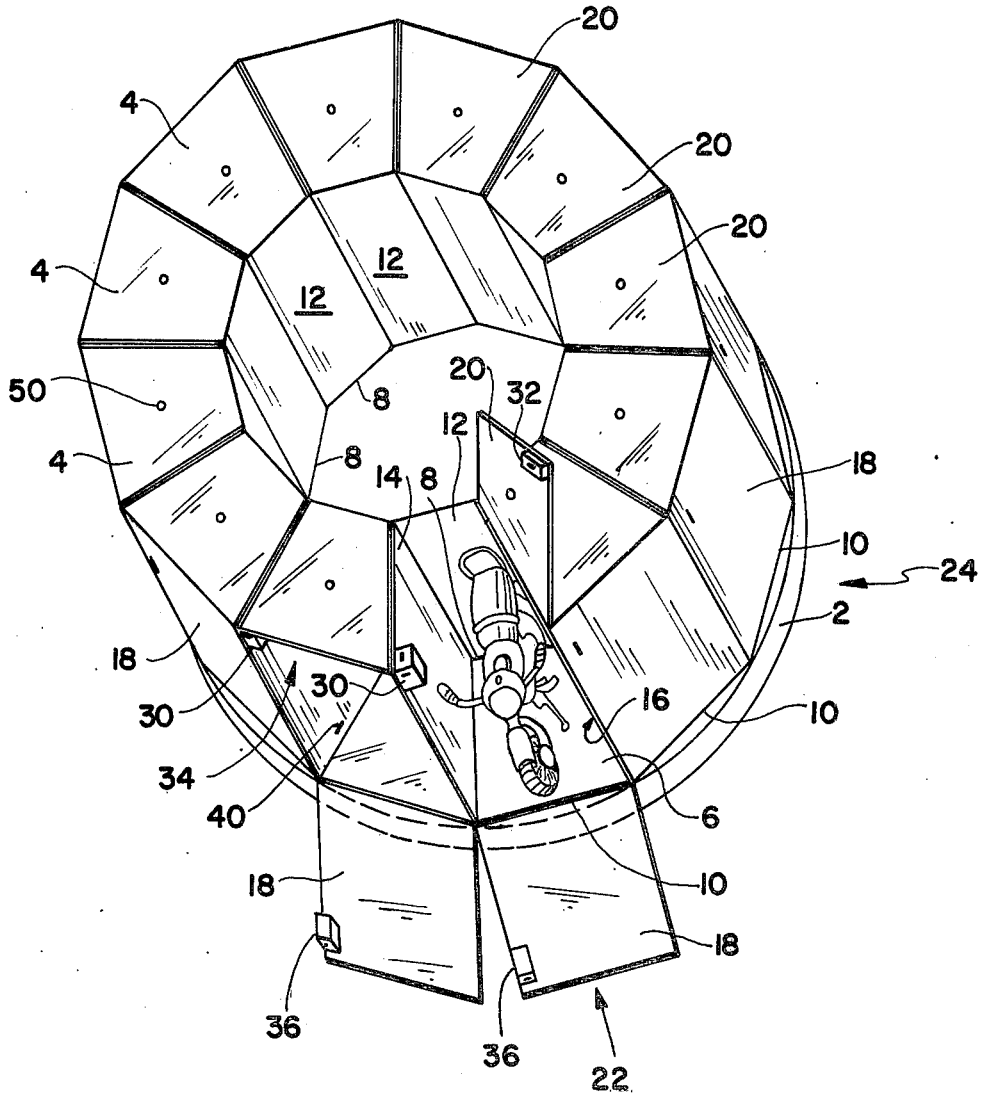
FIG. 1 is a perspective view of one form of garage assembly for two-wheeled vehicles illustrative of an embodiment of the invention.

Referring to FIG. 1, it will be seen that the illustrative assembly includes a rotatable circular frame means 2 which may, as illustrated, be in the form of a turntable. A plurality of housings 4 are connected to the frame 2. Each housing 4 includes a floor portion 6 having a back edge 8 and a front edge 10. The length of the back edge 8 is less than the length of the front edge 10. A back wall 12 is upstanding from the back edge 8 and side walls 14, 16 are upstanding from side edges of the floor portion 6.

A front wall 18 is hingedly connected to the front edge 10. A top portion 20 is shaped complementarily to the floor portion 6 and is hingedly connected to an upper edge of one of the side walls 16. The front wall 18 and the top portion 20 are movable between positions in which the housing is open, as shown at reference numeral 22 in FIG. 1 and positions in which the housing is closed, as shown at reference numeral 24 in FIG. 1.

A first lock means 30 is disposed in each housing 4 proximate a forward edge and an upper edge of one of the side walls 14. The top portion 20 is hingedly connected to the upper edge of the opposite side wall 16 and has disposed thereon a second lock means 32 mounted thereon and engageable with the first lock means 30 when the top portion 20 is in the closed position, as shown at reference numeral 34. A thick lock means 36 is disposed on the front wall 18 and is engageable with the first lock means 30 when the front wall is in the closed position. Thus, the lock means 30 is a dual lock and serves to receive the lock means 32 and 36 for locking engagement therewith, to securely close the housing 4.

As will be seen at reference numeral 22, the front wall 18, when in the open position, comprises a ramp means extending from the floor portion front edge 10 to a level below the turntable 2.

As seen in the drawing, the slant of the side walls 14, 16 is such that a plurality of the housings 4 may be positioned side-by-side in abutting relationship on the turntable.

Preferably, each housing 4 is provided with a plurality of tie-down hooks 40 and is also provided with a vent means 50 which may comprise simply an opening in the top portion of each housing, as shown, or preferably may comprise such an opening in combination with a cover (not shown) disposed over and removed from the opening to prevent the entry of rain through the vent opening.

It is to be understood that the present invention is by no means limited to the particular construction herein disclosed and/or shown in the drawings, but also comprises any modifications or equivalents within the scope of the disclosure.

Having thus described our invention what we claim as new and desire to secure by Letters Patent of the United States is:

1. A garage assembly for two-wheeled vehicles, said assembly comprising a rotatable circular frame, a plurality of housings connected to said frame, each said housing including a floor portion having a back edge and a front edge, the length of said back edge being less than the length of said front edge, a back wall upstanding from said back edge, side walls upstanding from side edges of said floor portion, a front wall hingedly connected to said front edge, a top portion shaped complementarily to said floor portion and hingedly connected to an upper edge of a first of said side walls, said front wall and said top portion being movable between positions in which said housing is open and in which said housing is closed, first lock means disposed in said housing proximate a forward edge and an upper edge of a second of said side walls, said top portion having second lock means mounted on an interior surface thereof and engageable with said first lock means when said top portion is in said closed position, and third lock means disposed on an interior surface of said front wall and engageable with said first lock means when said front wall is in said closed position.

2. The invention according to claim 1 in which said front wall in said open position comprises ramp means extending from said floor portion front edge.

3. The invention according to claim 1 in which said frame comprises a turntable on which are disposed said plurality of housings.

4. The invention according to claim 3 in which said housings are disposed side-by-side on said turntable, said front walls facing outwardly from said assembly.

5. The invention according to claim 4 in which said front wall in said open position comprises ramp means extending from said floor portion front edge to a level below the upper surface of said turntable.

6. The invention according to claim 5 including tie-down means disposed in said housing, said tie-down means comprising a plurality of tie-down hooks disposed in each of said housings.

7. The invention according to claim 6 including vent means disposed in said top portion, said vent means comprising opening means in said top portion.

* * * * *